United States Patent [19]

Watanabe et al.

[11] Patent Number: 5,006,420

[45] Date of Patent: Apr. 9, 1991

[54] ELECTROPLATED STEEL SHEET HAVING A PLURALITY OF COATINGS, EXCELLENT IN WORKABILITY, CORROSION RESISTANCE AND WATER-RESISTANT PAINT ADHESIVITY

[75] Inventors: Tsutomu Watanabe; Masaru Sagiyama; Masaki Kawabe; Masaya Morita, all of Tokyo, Japan

[73] Assignee: NKK Corporation, Tokyo, Japan

[21] Appl. No.: 531,503

[22] Filed: May 31, 1990

[30] Foreign Application Priority Data

Jun. 21, 1989 [JP] Japan ..... 1-159002

[51] Int. Cl.[5] ..... C25D 15/02; C25D 5/10

[52] U.S. Cl. ..... 428/629; 428/659

[58] Field of Search ..... 428/629, 659

[56] References Cited

FOREIGN PATENT DOCUMENTS

| | | |
|---|---|---|
| 0174019 | 3/1986 | European Pat. Off. . |
| 0245828 | 11/1987 | European Pat. Off. . |
| 57-67189 | 4/1982 | Japan . |
| 58-58294 | 4/1983 | Japan . |
| 58-100692 | 6/1983 | Japan . |
| 60-125390 | 7/1985 | Japan . |
| 60-152662 | 8/1985 | Japan . |
| 60-200996 | 10/1985 | Japan . |
| 63-192900 | 8/1988 | Japan . |
| 63-243295 | 10/1988 | Japan . |
| 64-00299 | 1/1989 | Japan . |

*Primary Examiner*—Theodore Morris
*Assistant Examiner*—David W. Schumaker
*Attorney, Agent, or Firm*—Frishauf, Holtz, Goodman & Woodward

[57] ABSTRACT

An electroplated steel sheet having a plurality of coatings, excellent in workability, corrosion resistance and water-resistant paint adhesivity, which comprises:

an iron-chromium-zinc alloy coating as a lower layer, having a coating weight of from 0.1 to 40 g/m$^2$ per side, formed on the surface of a steel sheet, consisting essentially of:

iron: from 3 to under 15 wt. %, chromium: from 0.1 to 1 wt. %, and the balance being zinc and incidental impurities;

another iron-chromium-zinc alloy coating as an intermediate layer, having a coating weight of from 20 to 59.9 g/m$^2$ per side, formed on the iron-chromium-zinc alloy coating as the lower layer, consisting essentially of:

iron: from 10 to 40 wt. %, chromium: from over 1 to under 30 wt. %, and the balance being zinc and incidental impurities;

and a chromating coating as an upper layer, formed on the another iron-chromium-zinc alloy coating as the intermediate layer, which comprises a metallic chromium film and a hydrated chromium oxide film, each having a coating weight of at least 5 mg/m$^2$ per side.

2 Claims, 3 Drawing Sheets

ELECTROPLATED STEEL SHEET HAVING A PLURALITY OF COATINGS, EXCELLENT IN WORKABILITY, CORROSION RESISTANCE AND WATER-RESISTANT PAINT ADHESIVITY

REFERENCE TO PATENTS, APPLICATIONS AND PUBLICATIONS PERTINENT TO THE INVENTION

As far as we know, there is available the following prior art document pertinent to the present invention:

Japanese Patent Provisional Publication No.63-243,295 dated Oct. 11, 1988.

The contents of the prior art disclosed in the above-mentioned prior art document will be discussed hereafter under the heading of the "BACKGROUND OF THE INVENTION".

FIELD OF THE INVENTION

The present invention relates to an electroplated steel sheet having a plurality of coatings, excellent in workability, corrosion resistance and water-resistant paint adhesivity.

BACKGROUND OF THE INVENTION

There is at present a strong demand for the improvement of corrosion resistance of a steel sheet forming an automobile body with a view to keeping safety and external appearance of the automobile body for a long period of time. A zinciferous electroplated steel sheet is excellent in corrosion resistance under the effect of a sacrificial protection of corrosion provided by its zinciferous coating. The zinciferous electroplated steel sheet is therefore widely applied as a steel sheet for automobile. Furthermore, a film of a chemically stable corrosion product is formed on the surface of a zinc alloy coating such as an iron-zinc alloy coating of an iron-zinc alloy electroplated steel sheet or a nickel-zinc alloy coating of a nickel-zinc alloy electroplated steel sheet. This film of the corrosion product inhibits a progress of subsequent corrosion of the above-mentioned zinc alloy coating, at a portion thereof, to the surface of which a paint film does not adhere. In addition, the zinc alloy coating, being excellent in alkali resistance, prevents corrosion of the steel sheet caused by alkalinization of water having penetrated through the paint film into the space between the paint film and the zinc alloy coating.

A nickel-zinc alloy electroplated steel sheet has a problem in that, during a progress of corrosion, a content ratio of nickel in the nickel-zinc alloy coating increases along with the decrease in the zinc content in the nickel-zinc alloy coating, thus leading to corrosion of the nickel-zinc alloy electroplated steel sheet. However, an iron-zinc alloy electroplated steel sheet imposes no such problem. Therefore, the iron-zinc alloy electroplated steel sheet has many advantages as a corrosion-resistant electroplated steel sheet.

However, the recent demand for the improvement of corrosion resistance of a steel sheet is becoming remarkably higher than the level of corrosion resistance of the conventional iron-zinc alloy electroplated steel sheet. For the purpose of coping with this increasing demand for a higher corrosion resistance, improvement of corrosion resistance of the coating is tried by adding, to the coating, a metal excellent in corrosion resistance such as chromium, in addition to iron and zinc, and for example, the following electroplated steel sheet is proposed:

An electroplated steel sheet excellent in corrosion resistance disclosed in Japanese Patent Provisional Publication No. 63-243,295 dated Oct. 11, 1988, which has any one alloy coating of the following (a) to (d) (hereinafter referred to as the "prior art"):

(a) an alloy coating, which comprises:
chromium: from over 1 to 70 wt. %, and
the balance being zinc and incidental impurities;

(b) a plurality of alloy coatings, which comprise:
(i) the alloy coating of the above (a), and
(ii) another alloy coating comprising at least one element selected from the group consisting of zinc, iron, nickel, cobalt, manganese, chromium, aluminum magnesium, silicon, molybdenum, copper, lead, tin, titanium, antimony and phosphorus;

(c) an alloy coating, which comprises:
chromium: from over 1 to 70 wt. %, at least one element selected from the group consisting of iron, nickel, cobalt, manganese, molybdenum, copper, lead, tin, antimony and phosphorus, the total content of said at least one element being smaller than the content of each of chromium and iron, and
the balance being zinc and incidental impurities;

(d) a plurality of alloy coatings, which comprise:
(i) the alloy coating of the above (c), and
(ii) another alloy coating comprising at least one element selected from the group consisting of zinc, iron, nickel, cobalt, manganese, chromium, aluminum, magnesium, silicon, molybdenum, copper, lead, tin, titanium, antimony and phosphorus.

The above-mentioned prior art has the following problems:

(1) A steel sheet for automobile is required to be excellent not only in corrosion resistance, but also in workability and water-resistant paint adhesivity. However, the electroplated steel sheet having the alloy coating (a) or (c) above of the prior art, i.e., the electroplated steel sheet which has a chromium-zinc alloy coating containing chromium of from over 1 to 70 wt. %, is very poor in workability and water-resistant paint adhesivity. Such an electroplated steel sheet is not therefore suitable as a steel sheet for automobile.

(2) Water-resistant paint adhesivity can be improved by forming an iron-rich iron-zinc alloy coating on the chromium-zinc alloy coating containing chromium of from over 1 to 70 wt. % as in the case of the electroplated steel sheet having the plurality of alloy coatings (b) or (d) of the prior art, under the effect of the iron-zinc alloy coating. However, the iron-zinc alloy coating is susceptible to corrosion. As a result, red rust is produced on the iron-zinc alloy coating, and this impairs formation of a film of a chemically stable corrosion product, thus leading to deterioration of corrosion resistance of the iron-zinc alloy coating. Therefore, formation of the plurality of alloy coatings (b) or (d) above of the prior art on the surface of the steel sheet cannot improve simultaneously both corrosion resistance and water-resistant paint adhesivity.

(3) As described above, it is impossible, in the electroplated steel sheet of the prior art, to satisfy all of workability, corrosion resistance and water-resistant paint adhesivity which a steel sheet for automobile is required to have.

Under such circumstances, there is a demand for the development of an electroplated steel sheet having a plurality of coatings, excellent in workability, corrosion resistance and water-resistant paint adhesivity, but an electroplated steel sheet provided with such properties has not as yet been proposed.

SUMMARY OF THE INVENTION

An object of the present invention is therefore to provide an electroplated steel sheet having a plurality of coatings, excellent in workability, corrosion resistance and water-resistant paint adhesivity.

In accordance with one of the features of the present invention, there is provided an electroplated steel sheet having a plurality of metal coatings, excellent in workability, corrosion resistance and water-resistant paint adhesivity, which comprises:

an iron-chromium-zinc alloy coating as a lower layer, formed on at least one surface of a steel sheet, consisting essentially of:

iron: from 3 to under 15 wt. %, chromium: from 0.1 to 1 wt %, and the balance being zinc and incidental impurities, said iron-chromium-zinc alloy coating as the lower layer having a coating weight of at least 0.1 $g/m^2$ per one surface of said steel sheet;

another iron-chromium-zinc alloy coating as an intermediate layer, formed on said iron-chromium-zinc alloy coating as the lower layer, consisting essentially of:

iron: from 10 to 40 wt. %, chromium: from over 1 to under 30 wt. %, and the balance being zinc and incidental impurities, said another iron-chromium-zinc alloy coating as the intermediate layer having a coating weight of at least 20 $g/m^2$ per one surface of said steel sheet, and the sum of said coating weight of said iron-chromium-zinc alloy coating as the lower layer and said coating weight of said another iron-chromium-zinc alloy coating as the intermediate layer being up to 60 $g/m^2$ per one surface of said steel sheet; and a chromating coating as an upper layer, formed on said another iron-chromium-zinc alloy coating as the intermediate layer, said chromating coating as the upper layer comprising a metallic chromium film formed on said another iron-chromium-zinc alloy coating as the intermediate layer, and a hydrated chromium oxide film formed on said metallic chromium film, and each of said metallic chromium film and said hydrated chromium oxide film having a coating weight of at least 5 $mg/m^2$ per one surface of said steel sheet.

DETAILED DESCRIPTION OF PREFERRED EMBODIMENTS

From the above-mentioned point of view, extensive studies were carried out to develop an electroplated steel sheet excellent in workability, corrosion resistance and water-resistant paint adhesivity. More specifically, an electroplated steel sheet having a plurality of coatings which have different chemical compositions from each other, displays simultaneously a plurality of functions which are unavailable by an electroplated steel sheet having a single coating. In order to cause the electroplated steel sheet to simultaneously display a plurality of functions, it is necessary to form, in a specific sequence, a plurality of coatings having respective specific functions on at least one surface of the steel sheet so that these coatings do not impair respective functions between them. Therefore, by forming, in a specific sequence, three coatings comprising a coating excellent in workability, another coating excellent in corrosion resistance, and further another coating excellent in water-resistant paint adhesivity on at least one surface of a steel sheet, it is possible to obtain an electroplated steel sheet most suitable as a steel sheet for automobile, which is excellent in workability, corrosion resistance and water-resistant paint adhesivity. Studies were therefore carried out to find conditions under which excellent workability, excellent corrosion resistance and excellent water-resistant paint adhesivity can be respectively imparted to the above-mentioned three coatings. As a result, the following findings were obtained:

(1) Workability of an iron-zinc alloy electroplated steel sheet deteriorates when an iron content in an alloy coating becomes at least 15 wt. %. The reasons are as follows: With an iron content of under 15 wt. % in the alloy coating, there is formed an iron-zinc alloy coating comprising a solid solution having an excellent workability, in which iron is dissolved into zinc. The iron-zinc alloy electroplated steel sheet has thus an excellent workability. With an iron content of at least 15 wt. % in the alloy coating, on the other hand, there is formed an iron-zinc alloy coating comprising a $\Gamma$ -phase having a poor workability, which is an intermetallic compound of iron and zinc. Workability of the iron-zinc alloy electroplated steel sheet is thus deteriorated.

Figure 1:
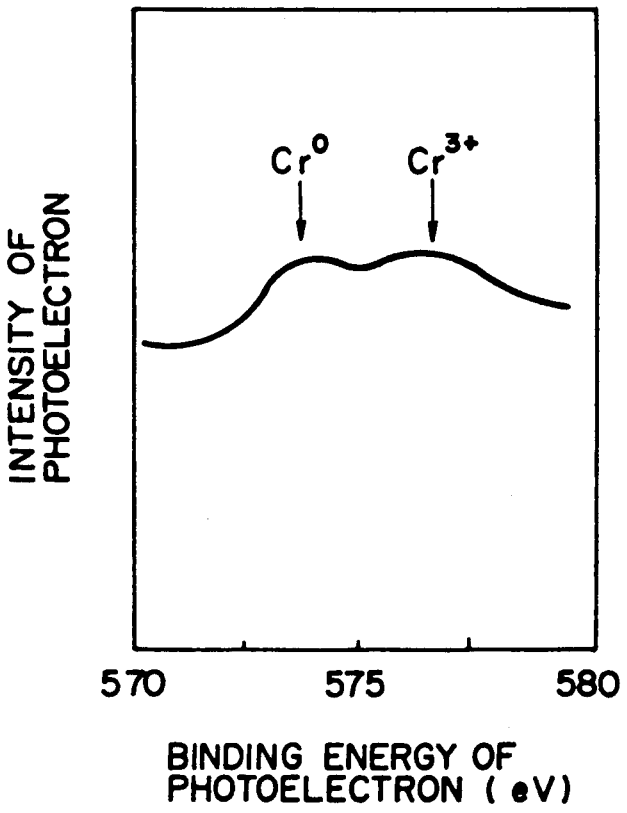
FIG. 1 is a graph illustrating the relationship between a binding energy of photoelectron and an intensity of photoelectron, when analyzing an iron-chromium-zinc alloy coating by means of an electron spectroscopy for chemical analysis.

(2) An iron-chromium-zinc alloy coating, comprising 17 wt. % iron, 5.9 wt. % chromium and the balance being zinc and incidental impurities, formed on the surface of a steel sheet, was analyzed by means of an electron spectroscopy for chemical analysis (sputtering time: 30 minutes). FIG. 1 is a graph illustrating the relationship between a binding energy of photoelectron and an intensity of photoelectron observed in the above-mentioned analysis. As shown in FIG. 1, $Cr^{3+}$ was detected in the alloy coating. This reveals that oxides and/or hydroxides of chromium are present in the alloy coating. An alloy coating containing oxides and/or hydroxides of chromium is brittle. Therefore, the iron-chromium-zinc alloy electroplated steel sheet has a lower workability than that of the iron-zinc alloy electroplated steel sheet, if the alloy coating has an iron content of at least 15 wt. % in the both cases.

Figure 2:
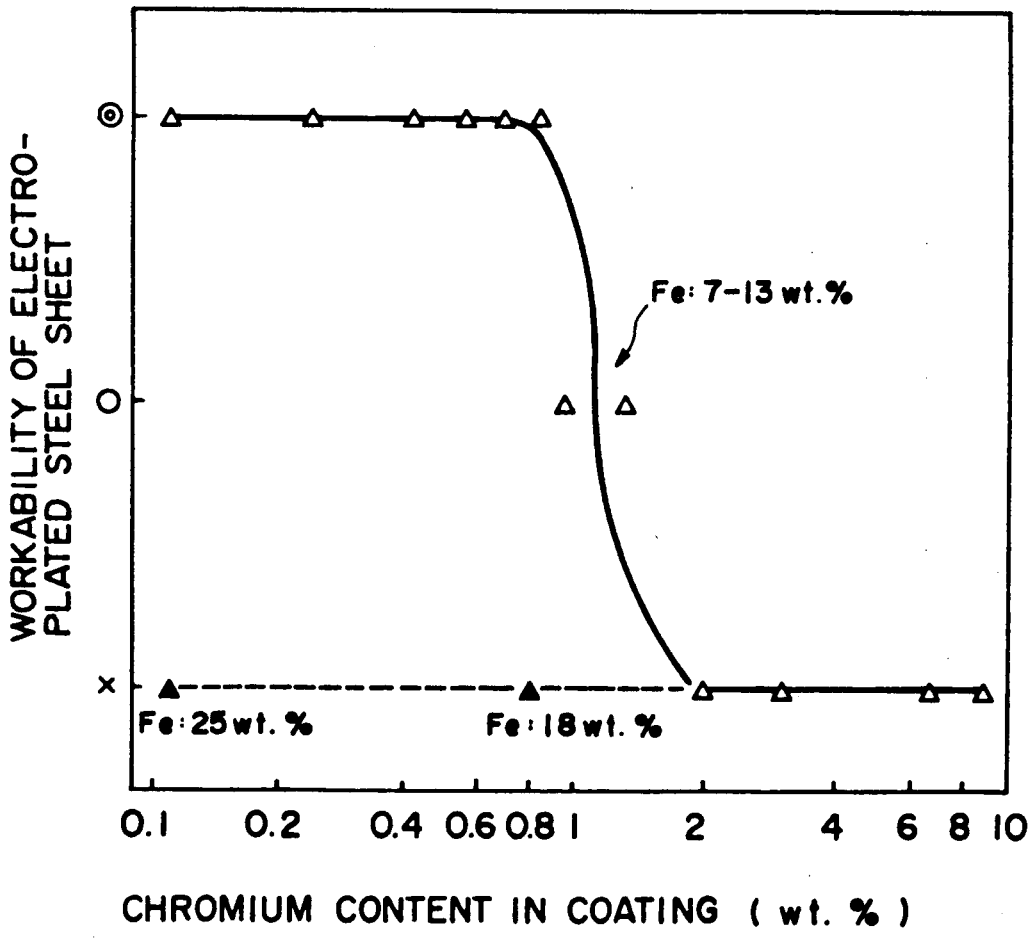
FIG. 2 is a graph illustrating the relationship between contents of iron and chromium in an alloy coating of an iron-chromium-zinc alloy electroplated steel sheet, on the one hand, and workability of the electroplated steel sheet, on the other hand.

(3) The relationship between contents of iron and chromium in an alloy coating of an iron-chromium-zinc alloy electroplated steel sheet, on the one hand, and workability of the electroplated steel sheet, on the other hand, was investigated. FIG. 2 is a graph illustrating the result of this investigation. In FIG. 2, the abscissa represents a chromium content in the alloy coating, and the ordinate represents workability of the electroplated steel sheet. Workability was evaluated using, as a criterion, workability of an alloy-treated hot-dip zinc plated steel sheet (coating weight: 60 g/m$^2$ per one surface of steel sheet) which has the minimum workability as a steel sheet for automobile. More specifically, the above-mentioned criterion is indicated by a mark "o", the case with a workability higher than the above-mentioned criterion is indicated by a mark "O", and the case with a workability lower than the above-mentioned criterion is indicated by a mark "x". In FIG. 2, a mark "Δ" represents an iron-chromium-zinc alloy electroplated steel sheet having an iron-chromium-zinc alloy coating (coating weight: 30 g/m$^2$ per one surface of steel sheet) containing iron within the range of from 7 to 13 wt. %, and a mark "▲" represents an iron-chromium-zinc alloy electroplated steel sheet having an iron-chromium-zinc alloy coating (coating weight: 30 g/m$^2$ per one surface of steel sheet) containing 18 wt. % iron or 25 wt. % iron.

As is clear from FIG. 2, workability of the iron-chromium-zinc alloy electroplated steel sheet (as indicated by the mark "Δ" containing iron within the range of from 7 to 13 wt. % in the alloy coating thereof is satisfactory with a chromium content in the alloy coating of up to 1 wt. %, whereas workability deteriorates with a chromium content in the alloy coating of over 1 wt. %. In contrast, workability of the iron-chromium-zinc alloy electroplated steel sheet (as indicated by the mark "▲") containing 18 wt. % iron or 25 wt. % iron in the alloy coating thereof deteriorates even with a chromium content of up to 1 wt. % in the alloy coating. Therefore, it is understood that workability of the iron-chromium-zinc alloy electroplated steel sheet is improved by limiting the iron content in the alloy coating to under 15 wt. % and limiting the chromium content in the alloy coating to up to 1 wt. %.

(4) Blister resistance and perforation corrosion resistance are considered important as representing corrosion resistance of a steel sheet for automobile. A blister tends to occur between a paint film and a coating under the effect of water penetrating through the paint film or corrosion liquid produced from corrosion of the coating mainly in an outer plate of an automobile body. If a blister occurs, adhesivity of the paint film remarkably decreases and corrosion resistance after painting deteriorates. Perforation corrosion tends to occur in a steel sheet through a paint film and a coating under the effect of corrosion caused by water or salt accumulating particularly in the closed portions of an automobile body.

Blister resistance of an iron-chromium-zinc alloy electroplated steel sheet is improved according as the contents of iron and chromium in the alloy coating increase. More particularly, an electroplated steel sheet having an iron-chromium-zinc alloy coating which contains at least 0 wt. % iron and over 1 wt. % chromium and has a coating weight of at least 20 g/m$^2$ per one surface of the steel sheet is superior in blister resistance to an alloy-treated hot-dip zinc plated steel sheet having a coating weight of at least 50 g/m$^2$ per one surface of steel sheet. A higher iron content in the alloy coating leads to an improved blister resistance because iron improves alkali resistance of the alloy coating, thus inhibiting corrosion of the alloy coating. The reason why a higher chromium content in the alloy coating improves blister resistance, though not clearly known, is estimated to be that chromium passivates the alloy coating and this inhibits corrosion of the alloy coating.

Figure 3:
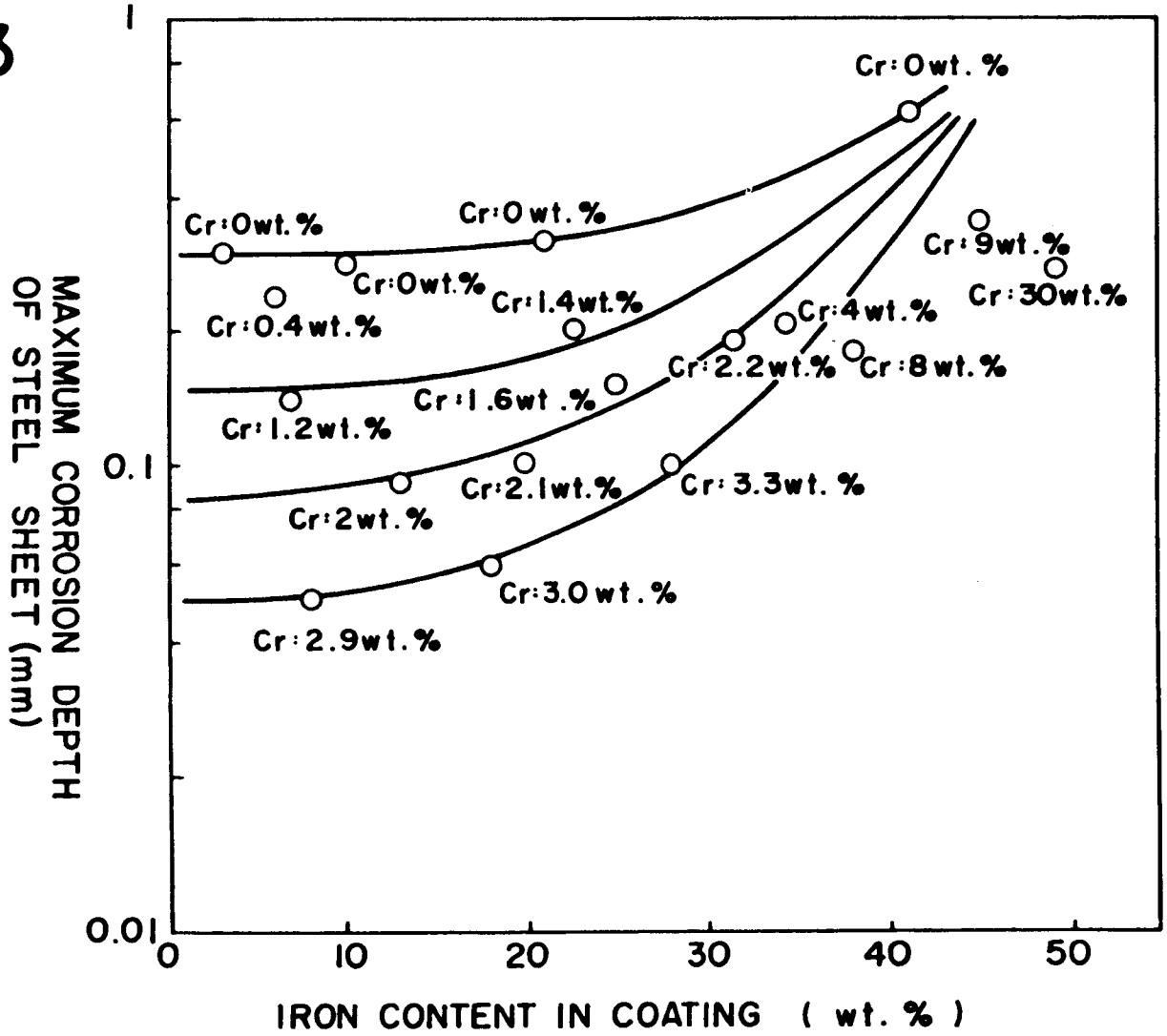
FIG. 3 is a graph illustrating the relationship between contents of iron and chromium in an alloy coating of an iron-chromium-zinc electroplated steel sheet, on the one hand, and perforation corrosion resistance of the electroplated steel sheet, on the other hand.

(5) The relationship between contents of iron and chromium in an alloy coating of an iron-chromium-zinc alloy electroplated steel sheet, on the one hand, and perforation corrosion resistance of the electroplated steel sheet, on the other hand, was investigated. FIG. 3 is a graph illustrating the result of this investigation. In FIG. 3, the abscissa represents an iron content in the alloy coating, and the ordinate represents a maximum corrosion depth of the steel sheet as a criterion of the perforation corrosion resistance. The maximum corrosion depth of the steel sheet was investigated through a perforation corrosion resistance test as described later. In FIG. 3, a mark "o" represents an iron-chromium-zinc electroplated steel sheet having an alloy coating (coating weight 30 g/m$^2$ per one surface of steel sheet) having a different chromium content.

As is clear from FIG. 3, a chromium content in the alloy coating of over 1 wt. % leads to a remarkably reduced maximum corrosion depth of the steel sheet, and hence to an improved perforation corrosion resistance. With an iron content in the alloy coating of over 40 wt. %, on the other hand, the maximum corrosion depth of the steel sheets becomes larger even with a chromium content of over 1 wt. %, thus resulting in a poorer perforation corrosion resistance. The reason why a chromium content in the alloy coating of over 1 wt. % leads to an improved perforation corrosion resistance is not clearly known, but is estimated to be that chromium passivates the alloy coating, and this inhibits corrosion of the alloy coating.

(6) The above-mentioned blister resistance and perforation corrosion resistance of the iron-chromium-zinc alloy electroplated steel sheet have correlation also with the coating weight of the alloy coating. More specifically, blister resistance and perforation corrosion resistance of an iron-chromium-zinc alloy electroplated steel sheet having an alloy coating containing over 1 wt. % chromium and from 10 to 40 wt. % iron, are improved over blister resistance and perforation corrosion resistance of an alloy-treated hot-dip zinc plated steel sheet having a coating weight of at least 50 g/m$^2$ per one surface of steel sheet, by using a coating weight of the alloy coating of at least 20 g/m$^2$ per one surface of steel sheet.

(7) In a steel sheet for automobile, water-resistant paint adhesivity is considered to be important. However, chromium, if contained in the alloy coating, causes deterioration of water-resistant paint adhesivity. Particularly, a chromium content of over 1 wt. % causes a serious deterioration of water-resistant paint adhesivity.

(8) A chromate coating comprising a metallic chromium film and a hydrated chromium oxide film is excellent in water-resistant paint adhesivity.

(9) Considering the above-mentioned findings, the conditions for improving workability, corrosion resistance and water-resistant paint adhesivity of an iron-chromium-zinc alloy electroplated steel sheet are as follows:

(a) In order to improve workability of the iron chromium-zinc alloy electroplated steel sheet, an iron content in the alloy coating should be under 15 wt. % and a chromium content in the alloy coating should be up to 1 wt. %.

(b) In order to improve blister resistance and perforation corrosion resistance of the iron-chromium-zinc alloy electroplated steel sheet, an iron content in the alloy coating should be within the range of from 10 to 40 wt. %, a chromium content in the alloy coating should be over 1 wt. %, and a coating weight of the alloy coating should be at least 20 g/m² per one surface of steel sheet.

(c) The iron-chromium-zinc alloy electroplated steel sheet has a poor water-resistant paint adhesivity. It is therefore necessary to form, on the alloy coating, a chromating coating excellent in water-resistant paint adhesivity.

The present invention was made on the basis of the above-mentioned findings. Now, the electroplated steel sheet having a plurality of coatings of the present invention, excellent in workability, corrosion resistance and water-resistant paint adhesivity is described below.

In the present invention, an iron-chromium-zinc alloy coating as a lower layer, consisting essentially of the following constituent elements, is formed on at least one surface of a steel sheet:

iron: from 3 to under 15 wt. %, chromium: from 0.1 to 1 wt. %, and the balance being zinc and incidental impurities.

The iron-chromium-zinc alloy coating as the lower layer has a coating weight of at least 0.1 g/m² per one surface of steel sheet.

The iron-chromium-zinc alloy coating as the lower layer imparts an excellent workability to the electroplated steel sheet. The iron content in the alloy coating should be limited within the range of from 3 to under 15 wt. %, and the chromium content in the alloy coating should be limited within the range of from 0.1 to 1 wt. %. When the iron content in the alloy coating is at least 15 wt. % and the chromium content in the alloy coating is over 1 wt. %, workability of the electroplated steel sheet is deteriorated. When the iron content in the alloy coating is under 3 wt. %, and the chromium content in the alloy coating is under 0.1 wt. %, on the other hand, blister resistance and perforation corrosion resistance of the electroplated steel sheet are deteriorated. The coating weight of the iron-chromium-zinc alloy coating as the lower layer should be at least 0.1 g/m² per one surface of steel sheet. With a coating weight of under 0.1 g/m² per one surface of steel sheet, a desired workability cannot be obtained.

In the present invention, another iron-chromium-zinc alloy coating as an intermediate layer, consisting essentially of the following constituent elements, is formed on the iron-chromium-zinc alloy coating as the lower layer:

iron: from 10 to 40 wt. %, chromium: from over 1 to under 30 wt. %, and the balance being zinc and incidental impurities.

The another iron-chromium-zinc alloy coating as the intermediate layer has a coating weight of at least 20 g/m² per one surface of steel sheet, and the sum of the coating weight of the iron-chromium-zinc alloy coating as the lower layer and the coating weight of the another iron-chromium-zinc alloy coating as the intermediate layer is up to 60 g/m² per one surface of steel sheet.

The another iron-chromium-zinc alloy coating as the intermediate layer imparts an excellent blister resistance and an excellent perforation corrosion resistance to the electroplated steel sheet. The iron content in the alloy coating should be limited within the range of from 10 to 40 wt. %, and the chromium content in the alloy coating should be limited within the range of from over 1 wt. % to under 30 wt. %. With an iron content in the alloy coating of under 10 wt. %, a desired blister resistance cannot be obtained. With an iron content in the alloy coating of over 40 wt. %, on the other hand, perforation corrosion resistance is deteriorated. With a chromium content in the alloy coating of up to 1 wt. %, a desired blister resistance and a desired perforation corrosion resistance cannot be obtained. A chromium content in the alloy coating of at least 30 wt. % leads, on the other hand, to a lower workability of the electroplated steel sheet. The coating weight of the another iron-chromium-zinc alloy coating as the intermediate layer should be at least 20 g/m² per one surface of steel sheet. With a coating weight of under 20 g/m² per one surface of steel sheet, a desired perforation corrosion resistance cannot be obtained.

The sum of the coating weight of the iron-chromium-zinc alloy coating as the lower layer and the coating weight of the another iron-chromium-zinc alloy coating as the intermediate layer should be limited to up to 60 g/m² per one surface of steel sheet. A sum of the coating weight of over 60 g/m² per one surface of steel sheet leads to a poorer workability of the electroplated steel sheet.

In the present invention, a chromating coating as an upper layer is formed on the another iron-chromium-zinc alloy coating as the intermediate layer. The chromating coating as the upper layer comprises a metallic chromium film formed on the another iron-chromium-zinc alloy coating as the intermediate layer, and a hydrated chromium oxide film formed on the metallic chromium film, and each of the metallic chromium film and the hydrated chromium oxide film has a coating weight of at least 5 mg/m² per one surface of steel sheet.

The chromating coating as the upper layer imparts an excellent water-resistant paint adhesivity to the electroplated steel sheet. More particularly, when a paint film is formed on the chromating coating as the upper layer, molecules of the paint film combine with molecules of the hydrated chromium oxide film of the chromating coating. Thus, the hydrated chromium oxide film of the chromating coating provides an excellent water-resistant paint adhesion. There is only a weak adhesivity between the hydrated chromium oxide film and the iron-chromium-zinc alloy coating. However, there is a strong adhesivity between the metallic chromium film and the iron-chromium-zinc alloy coating, and between the metallic chromium film and the hydrated chromium oxide film. Therefore, the metallic chromium film has a function of a binder for causing the hydrated chromium oxide film excellent in water-resistant paint adhesivity to closely adhere to the another iron-chromium-zinc alloy coating as the intermediate layer. The coating weight of each of the metallic chromium film and the hydrated chromium oxide film should be at least 5 mg/m² per one surface of steel sheet. With a coating weight of the hydrated chromium oxide film of under 5 mg/m² per one surface of steel sheet, a desired water-resistant paint adhesivity cannot be obtained. With a coating weight of the metallic chromium film of under 5 mg/m² per one surface of steel sheet, it is impossible to ensure firm adhesion of the hydrated chromium oxide film with the iron-chromium-zinc alloy coating. The upper limit of the coating weight of each of the metallic chromium film and the hydrated chromium oxide film, though not specifically limited, should preferably be up to 500 mg/m² per one surface of steel sheet for economic considerations.

The reason why the presence of the another iron-chromium-zinc alloy coating as the intermediate layer, which exerts an adverse effect on workability of the electroplated steel sheet, does not cause deterioration of workability of the electroplated steel sheet of the present invention is estimated as follows: The another iron-chromium-zinc alloy coating as the intermediate layer is formed on the iron-chromium-zinc alloy coating as the lower layer, which is excellent in workability, closely adhering to the surface of the steel sheet. When the electroplated steel sheet is subjected to working, cracks are produced in the iron-chromium-zinc alloy coating as the lower layer, and the alloy coating deforms, together with the steel sheet, along the cracks. The cracks thus produced in the iron-chromium-zinc alloy coating as the lower layer propagate to the another iron-chromium-zinc alloy coating as the intermediate layer, thus causing production of cracks in the intermediate layer similar to those in the lower layer. Therefore, the another iron-chromium-zinc alloy coating as the intermediate layer deforms, together with the iron-chromium-zinc alloy coating as the lower layer, along the cracks with the latter as a buffer.

When the iron content in the iron-chromium-zinc alloy coating as the lower layer is under 3 wt. % and the chromium content therein is under 0.1 wt. %, blister resistance and perforation corrosion resistance of the electroplated steel sheet are deteriorated even if the another iron-chromium-zinc alloy coating as the intermediate layer is formed thereon. The reason of this deterioration is estimated as follows: When the iron content in the iron-chromium-zinc alloy coating as the lower layer is under 3 wt. %, and the chromium content therein is under 0.1 wt. %, alkali resistance of the alloy coating becomes lower. As a result, corrosion of the iron-chromium-zinc alloy coating as the lower layer is caused by water and the like having penetrated through the cracks produced during working into the iron-chromium-zinc alloy coating as the lower layer. When the iron-chromium-zinc alloy coating as the lower layer is thus corroded, this causes deterioration of blister resistance and perforation corrosion resistance of the electroplated steel sheet imparted by the another iron-chromium-zinc alloy coating as the intermediate layer.

When the iron content in the iron-chromium-zinc alloy coating as the lower layer is at least 3 wt. %, and the chromium content therein is at least 0.1 wt. %, on the other hand, the alloy coating displays an excellent corrosion resistance in an alkaline environment under the effect of the alkali resistance improving function of iron and the passivating function of chromium. Therefore, even when water and the like penetrate through the cracks produced during working into the iron-chromium-zinc alloy coating as the lower layer, the alloy coating is never corroded As a result, there is caused no deterioration of blister resistance and perforation corrosion resistance of the electroplated steel sheet imparted by the another iron-chromium-zinc alloy coating as the intermediate layer formed on the iron-chromium-zinc alloy coating as the lower layer.

The excellent workability provided by the iron-chromium-zinc alloy coating as the lower layer, the excellent blister resistance and the excellent perforation corrosion resistance provided by the another iron-chromium-zinc alloy coating as the intermediate layer, and the excellent water-resistant paint adhesivity provided by the chromating coating as the upper layer are fully displayed without impairing each other, by limiting the chemical compositions of the lower layer, the intermediate layer and the upper layer as described above.

The above-mentioned electroplated steel sheet of the present invention is manufactured as follows: An iron-chromium-zinc alloy coating as a lower layer is electroplated onto the surface of a steel sheet in an electroplating bath mainly comprising zinc sulfate, ferrous sulfate and chromium sulfate. Then, another iron-chromium-zinc alloy coating as an intermediate layer is electroplated onto the iron-chromium-zinc alloy coating as the lower layer in another electroplating bath mainly comprising zinc sulfate, ferrous sulfate and chromium sulfate.

The contents of iron, chromium and zinc in the iron-chromium-zinc alloy coating as the lower layer and the another iron-chromium-zinc alloy coating as the intermediate layer can be adjusted by altering the contents of zinc sulfate, ferrous sulfate and chromium sulfate in the electroplating bath, the electric current density of plating, the pH-value of the plating bath and/or the flow velocity of the plating bath. More specifically, increase in the contents of ferrous sulfate and chromium sulfate in the electroplating bath, increase in the electric current density of plating, increase in the pH-value of the plating bath, or decrease in the flow velocity of the plating bath causes increase in the contents of iron and chromium in the alloy coating. Therefore, it is possible to form an iron-chromium-zinc alloy coating as the lower layer and another iron-chromium-zinc alloy coating as the intermediate layer respectively having prescribed contents of iron and chromium by altering the chemical composition of the electroplating baths and/or the plating conditions.

Then, the electroplated steel sheet on which the iron-chromium-zinc alloy coating as the lower layer and the another iron-chromium-zinc alloy coating as the intermediate layer have been formed as described above, is subjected to a cathode electrolytic chromating treatment in an acidic electrolytic chromating bath mainly comprising chromic acid and sulfuric acid ions, to form a chromating coating as an upper layer comprising a metallic chromium film and a hydrated chromium oxide film on the another iron-chromium-zinc alloy coating as the intermediate layer. Thus, there is manufactured the electroplated steel sheet of the present invention which comprises the iron-chromium-zinc alloy coating as the lower layer formed on the surface of the steel sheet, the another iron-chromium-zinc alloy coating as the intermediate layer formed on the iron-chromium-zinc alloy coating as the lower layer, and the chromating coating as the upper layer formed on the another iron-chromium-zinc alloy coating as the intermediate layer.

Now, the electroplated steel sheet of the present invention is described more in detail by means of examples in comparison with examples for comparison.

EXAMPLES

The surface of a cold-rolled steel sheet having a thickness of 0.7 mm was cleaned by means of usual alkali degreasing and electrolytic pickling. Then, the thus cleaned cold-rolled steel sheet was subjected to an electroplating treatment under the lower layer plating conditions as shown in Table 1 to form an iron-chromium-zinc alloy coating as a lower layer, and then, to another electroplating treatment under the intermediate layer plating conditions as shown in Table 1 to form another iron-chromium-zinc alloy coating as an intermediate layer on the iron-chromium-zinc alloy coating as the lower layer. Then, the electroplated steel sheet, on which the iron-chromium-zinc alloy coating as the lower layer and the another iron-chromium-zinc alloy coating as the intermediate layer had thus been formed, was subjected to an electrolytic chromating treatment under the upper layer chromating conditions as shown in Table 1 to form a chromating coating as an upper layer comprising a metallic chromium film and a hydrated chromium oxide film on the another iron-chromium-zinc alloy coating as the intermediate layer. Thus, samples Nos. 1 to 20 of the electroplated steel sheets of the present invention having three layers of alloy coating within the scope of the present invention as shown in Table 2 (hereinafter referred to as the "samples of the invention") were prepared.

For comparison purposes, samples Nos. 1 to 13 of the electroplated steel sheets for comparison having coatings outside the scope of the present invention as shown in Table 3 (hereinafter referred to as the "samples for comparison") were prepared. Each of the samples for comparison Nos. 1 and 2 had a single iron-chromium-zinc alloy coating formed under the intermediate layer plating conditions as shown in Table 1, on the surface of a cold-rolled steel sheet. Each of the samples for comparison Nos. 3 and 6 to 9 had no chromating coating as the upper layer. Each of the samples for comparison Nos. 4, 5 and 10 to 12 had a coating having chemical compositions outside the scope of the present invention. The sample for comparison No. 13 had an alloy-treated hot-dip zinc coating having a thickness of 60 g/m$^2$ on the surface of a cold-rolled steel sheet.

TABLE 1

| Plating condition | Chemical composition of plating bath (g/l) | pH-value of plating bath | Temperature of plating bath (°C.) | Electric current density of plating (A/dm$^2$) | Flow velocity of plating bath (m/sec) |
|---|---|---|---|---|---|
| Lower layer | Zinc sulfate ($ZnSO_4.7H_2O$):90–360<br>Ferrous sulfate ($FeSO_4.7H_2O$):10–240<br>Chromium sulfate ($Cr_2(SO_4)_3$):20–200<br>Sodium sulfate ($Na_2SO_4$):10–90 | 1.0–2.5 (adjusted by sulfuric acid) | 50 | 10–200 | 2–3 |
| Intermediate layer | Zinc sulfate ($ZnSO_4.7H_2O$):80–420<br>Ferrous sulfate ($FeSO_4.7H_2O$):20–480<br>Chromium sulfate ($Cr_2(SO_4)_3$):40–500<br>Sodium sulfate ($Na_2SO_4$):10–90 | 1.0–2.5 (adjusted by sulfuric acid) | 50 | 30–200 | 2–3 |
| Upper layer | Chromium anhydride ($CrO_3$):10–150<br>Sodium sulfate ($Na_2SO_4$):0.14–2.3 | | 50 | 10–100 | 0.5–3 |

TABLE 2

| No. | Lower layer Fe (wt. %) | Cr (wt. %) | Zn (wt. %) | Coating weight (g/m$^2$) | Intermediate layer Fe (wt. %) | Cr (wt. %) | Zn (wt. %) | Coating weight (g/m$^2$) |
|---|---|---|---|---|---|---|---|---|
| Sample of the invention | | | | | | | | |
| 1 | 3 | 0.1 | Balance | 1 | 20 | 2.4 | Balance | 25 |
| 2 | 7 | 0.6 | " | 1 | 20 | 2.4 | " | 25 |
| 3 | 10 | 0.8 | " | 1 | 20 | 2.4 | " | 25 |
| 4 | 14 | 1.0 | " | 1 | 20 | 2.4 | " | 25 |
| 5 | 10 | 0.8 | " | 0.1 | 20 | 2.4 | " | 25 |
| 6 | 10 | 0.8 | " | 5 | 10 | 1.2 | " | 25 |
| 7 | 7 | 0.4 | " | 3 | 28 | 3.0 | " | 25 |
| 8 | 7 | " | " | 3 | 34 | 5.0 | " | 25 |
| 9 | 7 | " | " | 3 | 38 | 8.0 | " | 25 |
| 10 | 7 | " | " | 3 | 28 | 24.0 | " | 25 |
| 11 | 7 | " | " | 10 | 20 | 3.6 | " | 25 |
| 12 | 7 | " | " | 20 | 20 | 3.6 | " | 25 |
| 13 | 7 | " | " | 30 | 20 | 3.6 | " | 25 |
| 14 | 7 | " | " | 10 | 20 | 2.4 | " | 30 |
| 15 | 7 | " | " | 10 | 12 | 1.2 | " | 40 |
| 16 | 7 | " | " | 10 | 12 | 1.2 | " | 50 |
| 17 | 5 | " | " | 5 | 20 | 2.4 | " | 25 |
| 18 | 5 | " | " | 5 | 20 | 2.4 | " | 25 |
| 19 | 5 | " | " | 5 | 20 | 2.4 | " | 25 |
| 20 | 5 | " | " | 5 | 20 | 2.4 | " | 25 |

| No. | Upper layer Metallic Cr (mg/m$^2$) | Cr oxide (mg/m$^2$) | Workability | Blister resistance (Max. blister width) (mm) | Perforation corrosion resistance (Max. corrosion depth) (mm) | Water-resistant paint adhesivity |
|---|---|---|---|---|---|---|
| 1 | 32 | 31 | o | 3.0 | 0.11 | o |
| 2 | 32 | 31 | o | 3.0 | 0.10 | o |
| 3 | 32 | 31 | o | 2.8 | 0.10 | o |
| 4 | 32 | 31 | o | 2.8 | 0.10 | o |
| 5 | 32 | 31 | o | 2.8 | 0.11 | o |
| 6 | 32 | 31 | o | 3.4 | 0.18 | o |
| 7 | 32 | 31 | o | 1.2 | 0.10 | o |
| 8 | 32 | 31 | o | 2.0 | 0.18 | o |
| 9 | 32 | 31 | o | 2.0 | 0.20 | o |
| 10 | 32 | 31 | o | 1.0 | 0.06 | o |

TABLE 2-continued

| | | | | | | |
|---|---|---|---|---|---|---|
| 11 | 32 | 31 | o | 2.0 | 0.08 | o |
| 12 | 32 | 31 | o | 2.2 | 0.04 | o |
| 13 | 32 | 31 | o | 2.4 | 0.01 | o |
| 14 | 32 | 31 | o | 2.1 | 0.08 | o |
| 15 | 32 | 31 | o | 3.2 | 0.08 | o |
| 16 | 32 | 31 | o | 2.3 | 0.04 | o |
| 17 | 11 | 21 | o | 3.0 | 0.10 | o |
| 18 | 108 | 51 | o | 2.9 | 0.09 | o |
| 19 | 48 | 105 | o | 2.9 | 0.09 | o |
| 20 | 110 | 220 | o | 2.6 | 0.09 | o |

TABLE 3

| | Lower layer | | | | Intermediate layer | | | |
|---|---|---|---|---|---|---|---|---|
| No. | Fe (wt. %) | Cr (wt. %) | Zn (wt. %) | Coating weight ($g/m^2$) | Fe (wt. %) | Cr (wt. %) | Zn (wt. %) | Coating weight ($g/m^2$) |
| Sample for comparison | | | | | | | | |
| 1 | 13 | 2.0 | Balance | 30 | — | — | — | — |
| 2 | 20 | 2.4 | " | 30 | — | — | — | — |
| 3 | 2 | 0.1 | " | 5 | 20 | 2.4 | Balance | 25 |
| 4 | 13 | 2.0 | " | 5 | 20 | 2.4 | " | 25 |
| 5 | 20 | 0.4 | " | 5 | 20 | 2.4 | " | 25 |
| 6 | 7 | 0.4 | " | 5 | 9 | 2.4 | " | 25 |
| 7 | 7 | 0.4 | " | 5 | 45 | 9.0 | " | 25 |
| 8 | 7 | 0.2 | " | 5 | 20 | 0.4 | " | 25 |
| 9 | 7 | 0.4 | " | 5 | 24 | 35.0 | " | 25 |
| 10 | 7 | 0.4 | " | 5 | 20 | 2.4 | " | 10 |
| 11 | 7 | 0.4 | " | 20 | 12 | 1.2 | " | 50 |
| 12 | 10 | 0.8 | " | 5 | 10 | 1.2 | " | 25 |
| 13 | 11 | — | " | 60 | — | — | — | — |

| | Upper layer | | | | | |
|---|---|---|---|---|---|---|
| No. | Metallic Cr ($mg/m^2$) | Cr oxide ($mg/m^2$) | Workability | Blister resistance (Max. blister width) (mm) | Perforation corrosion resistance (Max. corrosion depth) (mm) | Water-resistant paint adhesivity |
| 1 | — | — | x | 3.0 | 0.09 | x |
| 2 | — | — | x | 2.0 | 0.10 | x |
| 3 | — | — | o | 3.8 | 0.10 | x |
| 4 | 32 | 31 | x | 1.9 | 0.09 | o |
| 5 | 32 | 31 | x | 1.8 | 0.11 | o |
| 6 | — | — | o | 4.3 | 0.13 | x |
| 7 | — | — | o | 3.0 | 0.35 | x |
| 8 | — | — | o | 3.8 | 0.25 | x |
| 9 | — | — | x | 0.8 | 0.04 | x |
| 10 | 32 | 31 | o | 2.6 | 0.26 | o |
| 11 | 32 | 31 | x | 3.0 | 0.06 | o |
| 12 | 2 | 2 | o | 3.4 | 0.18 | x |
| 13 | — | — | Δ | 3.5 | 0.22 | Δ |

For each of the thus prepared samples of the invention Nos. 1 to 20 and the samples for comparison Nos. 1 to 13, workability, blister resistance, perforation corrosion resistance and water-resistant paint adhesivity were investigated by means of the following performance tests. The results of these tests are shown also in Tables 2 and 3.

(1) WORKABILITY TEST

The alloy coating of each of the as-plated samples was squeezed while causing deformation thereof by means of a draw-bead tester (diameter of the projection of the male die: 0.5 mm). Then, an adhesive tape was stuck to the alloy coating of the thus deformed and squeezed sample, and the adhesive tape was then peeled off. The degree of blackening of the adhesive tape caused by adhesion of the peeled-off alloy coating was determined by visual inspection as the amount of the peeled-off alloy coating, and workability was evaluated in terms of the degree of blackening, i.e., the amount of the peeled-off alloy coating. The criteria for evaluation were as follows:

o : An amount of the peeled-off alloy coating is smaller than that for the sample for comparison No. 13 having the alloy-treated hot-dip zinc coating on the surface of the steel sheet, suggesting a satisfactory workability;

Δ : An amount of the peeled-off alloy coating is of the same order as that for the sample for comparison No. 13; and x : An amount of the peeled-off alloy coating is larger than that for the sample for comparison No. 13, suggesting a poor workability.

(2) BLISTER RESISTANCE TEST

Each sample was subjected to an immersion-type phosphating treatment for a steel sheet for automobile in a phosphating solution (product name: PL 3080) made by Nihon Perkerizing Co., Ltd. to form a phosphate film on the surface of the sample, and then subjected to a cation-type electropainting treatment with the use of a paint (product name: ELECRON 9400) made by Kansai Paint Co., Ltd. to form a paint film having a thickness of 20 μm on the phosphate film. Then, a cruciform notch was cut on the thus formed paint film. For the resultant sample having the cruciform notch, the maximum blister width of the paint film was measured on one side of the cruciform notch after the lapse of 1,000 hours in a salt spray test, and blister resistance was evaluated on the basis of the thus measured maximum blister width of the paint film.

(3) PERFORATION CORROSION RESISTANCE TEST

Each sample provided with the cruciform notch as described in (2) above was subjected to 60 cycles of tests, each cycle comprising salt spray, drying, immersion in salt water, wetting and drying for 24 hours. Then, the paint film and the corrosion product were removed from the sample subjected to 60 cycles of tests, and the maximum corrosion depth produced in the steel sheet was measured to evaluate perforation corrosion resistance on the basis of the thus measured maximum corrosion depth.

(4) WATER-RESISTANT PAINT ADHESIVITY TEST

Each sample was subjected to an immersion-type phosphating treatment for a steel sheet for automobile in a phosphating solution (product name PL 3080) made by Nihon Perkerizing Co., Ltd. to form a phosphate film on the surface of the sample, and then subjected to a cation-type electropainting treatment with the use of a paint (product name: ELECRON 9400) made by Kansai Paint Co., Ltd. to form a lower paint film having a thickness of 20 μm on the phosphate film. Then, an intermediate paint film having a thickness of 35 μm and an upper paint film having a thickness of 35 μm were formed on the surface of the thus formed lower paint film. The resultant sample having three layers of paint film was immersed in pure water at a temperature of 40° C. for 240 hours, and then 100 checker notches were cut an intervals of 2 mm on the paint film. An adhesive tape was stuck to the surface of the paint film having the checker notches, and then, the adhesive tape was peeled off. The number of paint film sections peeled off together with the adhesive tape was counted to evaluate water-resistant paint adhesivity on the basis of the number of paint film sections peeled off. The criteria for evaluation were as follows:

o : The number of peeled-off sections is up to 5;

Δ : The number of peeled-off sections is from 6 to 20;

x : The number of peeled-off sections is at least 21.

As is clear from Table 3, the samples for comparison Nos. 1 and 2, each having a single iron-chromium-zinc alloy coating, are poor in workability and water-resistant paint adhesivity. The sample for comparison No. 3, in which the iron content in the iron-chromium-zinc alloy coating as the lower layer is low outside the scope of the present invention and which has no chromating coating as the upper layer, is poor in blister resistance and water-resistant paint adhesivity. Both of the sample for comparison No. 4, in which the chromium content in the iron-chromium-zinc alloy coating as the lower layer is high outside the scope of the present invention, and the sample for comparison No. 5, in which the iron content in the iron-chromium-zinc alloy coating as the lower layer is high outside the scope of the present invention, are poor in workability.

The samples for comparison Nos. 6 to 9, each having no chromating coating as the upper layer, are poor in water-resistant paint adhesivity in any case. The sample for comparison No. 6, furthermore, in which the iron content in the iron-chromium-zinc alloy coating corresponding to the intermediate layer of the present invention is low outside the scope of the present invention, is poor in blister resistance. The sample for comparison No. 7, in which the iron content in the iron-chromium-zinc alloy coating corresponding to the intermediate layer of the present invention is high outside the scope of the present invention, is poor in perforation corrosion resistance. The sample for comparison No. 8, in which the chromium content in the iron-chromium-zinc alloy coating corresponding to the intermediate layer of the present invention is low outside the scope of the present invention, is poor in blister resistance and perforation corrosion resistance. The sample for comparison No. 9, in which the chromium content in the iron-chromium-zinc alloy coating corresponding to the intermediate layer of the present invention is high outside the scope of the present invention, is low in workability.

The sample for comparison No. 10, in which the coating weight of the another iron-chromium-zinc alloy coating as the intermediate layer is small outside the scope of the present invention, is poor in perforation corrosion resistance. The sample for comparison No. 11, in which the sum of the coating weight of the iron-chromium-zinc alloy coating as the lower layer and the coating weight of the another iron-chromium-zinc alloy coating as the intermediate layer is large outside the scope of the present invention, is poor in workability. The sample for comparison No. 12, in which the coating weight of the metallic chromium film and the coating weight of the hydrated chromium oxide film of the chromating coating as the upper layer are small outside the scope of the present invention, is poor in water-resistant paint adhesivity. Finally, the sample for comparison No. 13, in which the alloy-treated hot-dip zinc coating is formed on the surface of the steel sheet, is slightly poor in workability and water-resistant paint adhesivity.

To the contrary, as is clear from Table 2, all the samples of the invention Nos. 1 to 20 are excellent in workability, blister resistance, perforation corrosion resistance and water-resistant paint adhesivity.

According to the present invention, as described above in detail, it is possible to obtain an electroplated steel sheet having a plurality of coatings, which is excellent in workability, corrosion resistance and water-resistant paint adhesivity, thus providing industrially useful effect.

What is claimed is:

1. An electroplated steel sheet having a plurality of coatings, excellent in workability, corrosion resistance and water-resistant paint adhesivity, which comprises:

an iron-chromium-zinc alloy coating as a lower layer, formed on at least one surface of a steel sheet, consisting essentially of:

iron: from 3 to under 15 wt. %, chromium: from 0.1 to 1 wt. %, and the balance being zinc and incidental impurities, said iron-chromium-zinc alloy coating as the lower layer having a coating weight of at least 0.1 g/m$^2$ per one surface of said steel sheet;

another iron-chromium-zinc alloy coating as an intermediate layer, formed on said iron-chromium-zinc alloy coating as the lower layer, consisting essentially of:

iron: from 10 to 40 wt. %, chromium: from over 1 to under 30 wt. %, and the balance being zinc and incidental impurities, said another iron-chromium-zinc alloy coating as the intermediate layer having a coating weight of at least 20 g/m$^2$ per one surface of said steel sheet, and the sum of said coating weight of said iron-chromium-zinc alloy coating as the lower layer and said coating weight of said another iron-chromium-zinc alloy coating as the intermediate layer being up to 60 g/m$^2$ per one surface of said steel sheet; and a chromating coating as an upper layer, formed on said another iron-chromium-zinc alloy coating as the intermediate layer, said chromating coating as the upper layer comprising a metallic chromium film formed on said another iron-chromium-zinc alloy coating as the intermediate layer, and a hydrated chromium oxide film formed on said metallic chromium film, and each of said metallic chromium film and said hydrated chromium oxide film having a coating weight of at least 5 mg/m$^2$ per one surface of said steel sheet.

2. The electroplated steel sheet as claimed in claim 1, wherein:

each of said metallic chromium film and said hydrated chromium oxide film has a coating weight of up to 500 mg/m$^2$ per one surface of said steel sheet.

* * * * *